US011524818B2

(12) United States Patent
McElveen, II et al.

(10) Patent No.: US 11,524,818 B2
(45) Date of Patent: Dec. 13, 2022

(54) CONTAINER AND RELATED METHODS

(71) Applicant: Halex/Scott Fetzer Company, Harrison, OH (US)

(72) Inventors: David Vaughn McElveen, II, Cincinnati, OH (US); Daniel Felipe Restrepo, Cincinnati, OH (US); Randal Charles Moss, Cincinnati, OH (US)

(73) Assignee: Halex/Scott Fetzer Company, Harrison, OH (US)

( * ) Notice: Subject to any disclaimer, the term of this patent is extended or adjusted under 35 U.S.C. 154(b) by 0 days.

(21) Appl. No.: 17/011,777

(22) Filed: Sep. 3, 2020

(65) Prior Publication Data

US 2021/0070506 A1 Mar. 11, 2021

Related U.S. Application Data

(60) Provisional application No. 62/898,259, filed on Sep. 10, 2019.

(51) Int. Cl.
*B65D 43/22* (2006.01)
*B65D 21/02* (2006.01)
(Continued)

(52) U.S. Cl.
CPC ..... *B65D 43/22* (2013.01); *B65D 1/22* (2013.01); *B65D 21/0215* (2013.01);
(Continued)

(58) Field of Classification Search
CPC ..... B65D 21/0219; B65D 21/0222; B65D 21/0223; B65D 43/22; B65D 43/162; B65D 44/06
See application file for complete search history.

(56) References Cited

U.S. PATENT DOCUMENTS 2,960,134 A 11/1960 Fornas
3,326,410 A 6/1967 Asenbauer
(Continued)

FOREIGN PATENT DOCUMENTS

WO 9301984 2/1993
WO 0185558 11/2001
(Continued)

OTHER PUBLICATIONS

"Halex Wins Award for Innovative Packaging Concept", Electrical Wholesaling, https://www.ewweb.com/news/bulletin-board/article/20922427/halex-wins-award-for-innovative-packaging-concept, Jul. 30, 2015, 7 pp.
(Continued)

*Primary Examiner* — Andrew T Kirsch
(74) *Attorney, Agent, or Firm* — Fitch, Even, Tabin & Flannery LLP

(57) ABSTRACT

A one-piece molded container comprising a lid and a container body is provided. The container body and lid are connected by a living hinge. The container body has interior protrusions extending from a bottom portion in an interior of the container body to limit nesting of the containers. The container body has a recess on a bottom portion on an exterior portion of the container and a dual-prong lid-locking mechanism, the lid-locking mechanism including a first prong, a second prong being a tamper-evident tearaway portion, and a protrusion extending downwardly from an interior portion of the lid.

16 Claims, 9 Drawing Sheets

(51) Int. Cl.
*B65D 43/16* (2006.01)
*B65D 1/22* (2006.01)
*B65D 55/06* (2006.01)

(52) U.S. Cl.
CPC ..... *B65D 21/0233* (2013.01); *B65D 43/162* (2013.01); *B65D 55/06* (2013.01); *B65D 2543/00027* (2013.01); *B65D 2543/00324* (2013.01); *B65D 2543/00472* (2013.01)

(56) References Cited

U.S. PATENT DOCUMENTS 4,267,700 A 5/1981 Minter
4,341,091 A 7/1982 Minter
4,416,374 A 11/1983 Smith
4,756,420 A 7/1988 Deaton
4,819,795 A 4/1989 Swaney
D315,099 S 3/1991 Alizard
5,170,905 A 12/1992 Luch
5,204,130 A 4/1993 McDevitt
D349,646 S 8/1994 Dickinson
D351,792 S 10/1994 Morris
5,445,397 A 8/1995 Evans
D379,122 S * 5/1997 Wolff ..... D3/312
5,897,019 A 4/1999 Stropkay
5,938,068 A * 8/1999 Atkins ..... B65D 43/162 220/839
6,276,530 B1 8/2001 Bailey
6,318,586 B1 11/2001 Frankenberg
6,431,394 B2 8/2002 Frankenberg
7,073,680 B2 7/2006 Boback
7,100,770 B2 9/2006 D Amato
7,118,003 B2 10/2006 Sellari
7,284,673 B2 10/2007 Habeger
7,320,405 B2 1/2008 Stahl
7,322,475 B2 1/2008 Hassell
7,543,705 B2 6/2009 Yourist
D619,889 S 7/2010 Short
8,091,731 B2 1/2012 Kidd
D656,369 S 3/2012 Everson
8,146,796 B2 4/2012 D Amato
8,172,127 B2 5/2012 Frost
D664,845 S 8/2012 Everson
8,245,875 B2 8/2012 Everson
D666,879 S 9/2012 Everson
8,261,933 B2 9/2012 Kidd
D668,119 S 10/2012 Everson
D668,144 S 10/2012 Swart
8,360,265 B1 1/2013 Andrews
8,381,946 B2 2/2013 Everson
8,474,622 B2 7/2013 Carver, III
D692,748 S 11/2013 Short
8,607,981 B2 12/2013 Wojno
8,657,138 B2 2/2014 Everson
8,695,831 B2 4/2014 Schick
8,795,580 B2 8/2014 Sellari
8,869,985 B2 10/2014 Schick
8,985,334 B2 3/2015 Mays
8,985,386 B2 3/2015 Everson
8,992,111 B2 3/2015 Bachman
9,120,595 B2 9/2015 Chou
9,187,209 B1 11/2015 Hanna
9,205,953 B2 12/2015 Andrews
9,272,814 B2 3/2016 Carver
9,387,963 B2 7/2016 McBroom
9,527,640 B2 12/2016 Sellari
9,630,756 B2 4/2017 Sellari
9,731,862 B2 8/2017 Mays
9,745,106 B2 8/2017 Siskindovich
9,828,162 B2 11/2017 Bachman
10,005,596 B2 6/2018 McBroom
10,065,765 B2 9/2018 Stanek
10,099,840 B2 10/2018 Frost
D840,803 S 2/2019 Poorman
D843,831 S 3/2019 Poorman
2005/0205570 A1* 9/2005 Ramirez ..... B65D 1/24 220/4.21
2007/0164033 A1 7/2007 Maia
2008/0041861 A1* 2/2008 Crawford ..... B65D 21/022 220/697
2008/0190930 A1* 8/2008 Vogel ..... B65D 21/0233 220/276
2011/0163107 A1* 7/2011 Saunders ..... B44D 3/14 220/694
2012/0012493 A1* 1/2012 Cleveland ..... B65D 21/0223 206/508
2012/0125937 A1 5/2012 Ahlstrom
2014/0027458 A1 1/2014 Liu
2016/0264316 A1 9/2016 Quinn
2018/0178952 A1 6/2018 Yeagley
2018/0339820 A1 11/2018 Reinhart

FOREIGN PATENT DOCUMENTS

WO 02060767 8/2002
WO 2005005273 1/2005
WO 2005105585 11/2005
WO 2011041528 4/2011
WO 2013163583 10/2013
WO 2014116746 7/2014
WO 2014152615 9/2014

OTHER PUBLICATIONS

Halex, Halex Wins 2015 Gold Innovation Award, https://www.halexco.com/whatsnew.cfm?siteSection=sales&newsID=28, Jul. 30, 2015, 1 p.
Halex, Installation Guide, Howto Install and Use Halex Electrical Fittings and Accessories, 2019, 10 pp.

* cited by examiner

CONTAINER AND RELATED METHODS

CROSS-REFERENCE TO RELATED APPLICATION

This application claims priority to U.S. Application No. 62/898,259, filed Sep. 10, 2019, and is incorporated herein in its entirety.

FIELD

This invention relates generally to containers and, more particularly, to one-piece or integrally molded containers that are stackable and nestable, and methods relating to same.

BACKGROUND

Containers are used to package numerous items for sale and use and by consumers to store the same items after purchase. For example, containers are used to package numerous items in bulk for tradespeople such as for fittings, connectors, couplers, clips and other fasteners, etc. The tradespeople also use the same containers for storing these items while they are used during their work. Some containers have lids that are removable from the containers, such as friction fit pull-off lids and others that screw on and off via complimentary threading between the lid and container opening. Common problems with containers include that the opening is too small for a tradesperson to reach in with his/her hand (e.g., often times the opening is not sized to fit all sizes of hands), the lid is not easy to operate with one hand (thereby requiring two hands to open and close the container), the container is not easy to keep within reach of the contractor because there is no place for the contractor to store the container nearby, and there is no way of determining whether a container has been tampered with (a big problem for hardware stores is that bulk packaging gets opened and pieces removed without being paid for and a subsequent purchaser of the bulk package can get shorted if the missing piece or pieces are not detected). As a result, parts may be lost, stolen, damaged, and ultimately, the contractor's job is made more difficult. Thus, it is the object of the present container to provide a container that is easy to use, access, store and has a tamper-evident feature.

BRIEF DESCRIPTION OF THE FIGURES

Embodiments of the invention are illustrated in the figures of the accompanying drawings in which.

Figure 1:
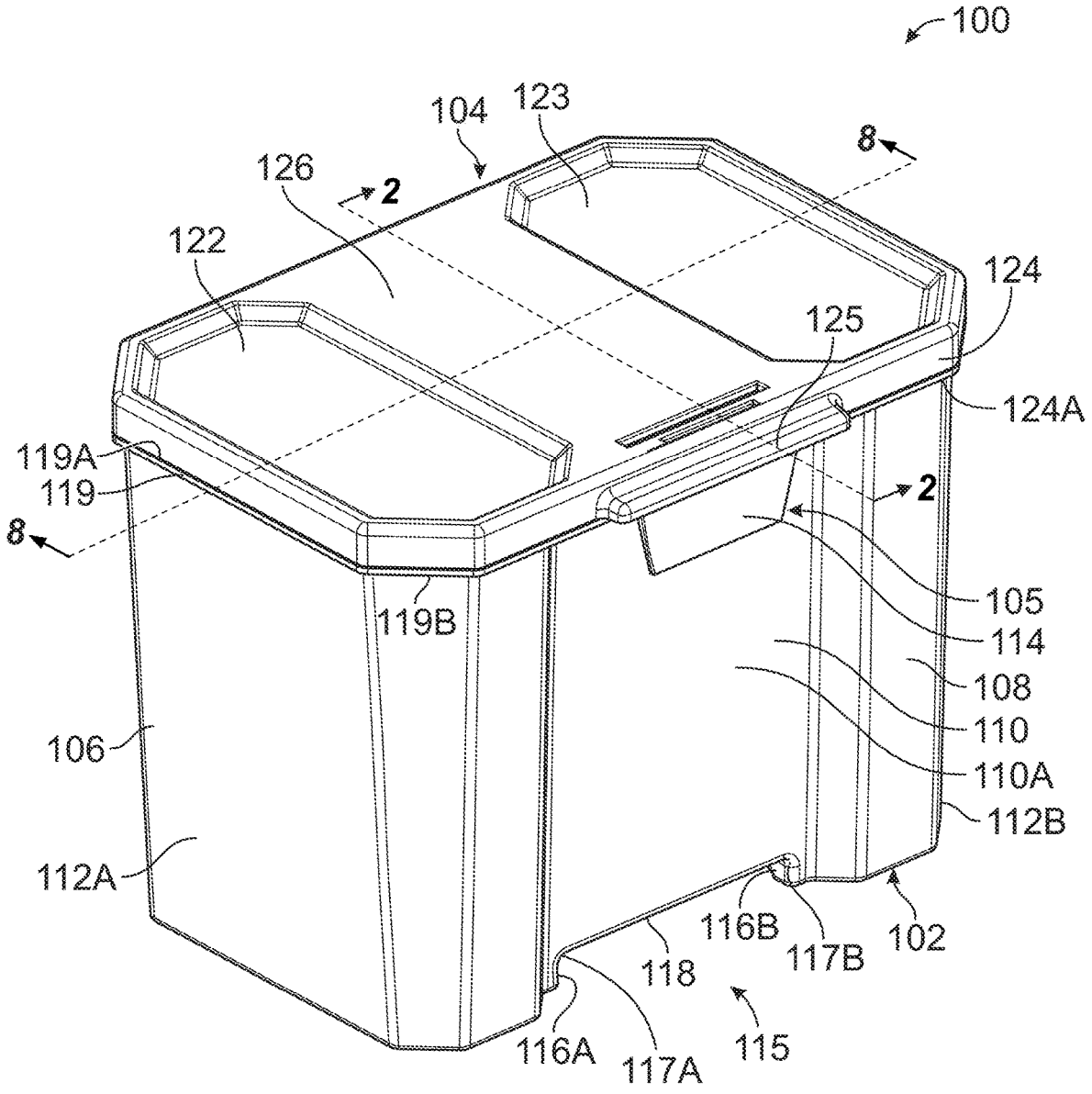
FIG. 1 is a perspective view of a container in a first closed configuration.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DESCRIPTION OF THE PREFERRED EMBODIMENTS

Many variations of containers are discussed herein and even further are contemplated in view of this disclosure. The containers discussed herein are configured, and designed, to be stackable and nestable, and to have a removable tamper-evident portion. The container herein can be manufactured in a variety of ergonomic shapes and in a variety of sizes, and further may be suitable for holding a variety of hardware, including, but not limited to fittings, connectors, couplers, clips and other fasteners, etc. In some embodiments and some applications, the container is referred to as a contractor clear pack and is translucent so that the tradesperson using the container can easily tell what is in the container (which is particularly helpful when dealing with multiple containers of the same type). In some forms, the container will actually be transparent so that a clear view of the contents of the container can be obtained.

Before going into a detailed explanation of the container 100 illustrated in the figures and as a brief summary, various different containers can be formed in accordance with the inventions disclosed herein. The container 100 will be an integrally molded container having a body 102 defining a receptacle 149 for receiving an article disposed therein (e.g., hardware, etc.) and an opening providing access to the receptacle, and a lid 104 integrally formed with the body and connected to the body via a living hinge 146, with the lid 104 being movable between a first open position wherein the opening to the receptacle is at least partially uncovered and a second closed position wherein the lid 104 covers the opening of the receptacle 149 defined by the body 102. In a preferred form, the opening of the container extends to the perimeter of the sidewalls of the container in order to provide a large unobstructed opening that the container user can easily reach his/her hand into in order to extract an article stored in the container 100.

The container 100 will be removed from the mold in an open configuration and can then be stacked for shipping purposes. The container 100 will then be filled with the items it is intended to package and the lid 104 will be moved from the initial open position to a closed position. Once closed, a tamper-evident seal prevents the lid 104 from being opened again until the seal is removed (e.g., torn off, broken off, etc.). In this way, stores will be able to know that items have not improperly been removed from the container packaging and consumers will be able to know that items have not been removed from the container packaging because the seal is still present. After the seal is removed, the lid 104 will be able to be opened and closed as desired with a lock mechanism 105 keeping the lid in the closed position until a user desires to open the container 100 again. In a preferred form, all of these components (e.g., container body 102, lid 104 and lock mechanism 105) will be formed integrally with one another in a single molding process.

In the form shown, the lock mechanism 105 includes a first mating structure or lock 121 extending from the lid and a second mating structure or container body interconnecting member 120 is located on the body for mating with the lock 121 to secure the lid 104 to the body 102 when in the second closed position. In a preferred form, the lock mechanism 105 and seal 114 will be formed integrally with one another via the same single molding process, and the lock 121 is shown as a hook extending from the lid 104 and the container body interconnecting member 120 is a protruding surface, such as a ledge or wall that the hook is able to engage in order to keep the lid 104 in the closed position once placed in that position. Numerous other types of lock configurations may be used (e.g., male/female mating structures, fasteners, etc.), however, in a preferred form, the lock mechanism 105 will only require one hand to operate so the user can easily open it while holding something else in their other hand (e.g., such as a tool or the like). While terms such as first structure and second structure, and first position and second position, it should be understood that these could be reversed if desired. Thus, for example, while it has been mentioned that the lid moves between a first open position and a second closed position, in alternate descriptions this terminology can be reversed if desired to refer to the lid moving between a first closed position and a second open position.

The container 100 may include a recess 115 for receiving at least a portion of an object so that the container may be rested on the object. In the form shown, the recess is formed in the bottom of the container 100 and is sized to fit a conventional 2"×4" building material structure or item (e.g., lumber such as a wood board, stud or plank, metal stud or beam, etc.) 162 so that the container 100 can be rested on such a structure when used at a worksite. In the form shown, the container body 100 is formed by a bottom wall with sidewalls extending upward therefrom, the sidewalls terminating at a distal end and defining the opening at the distal end of the sidewalls which the lid 104 ultimately covers, with the recess 115 being positioned in at least one of the bottom wall and/or sidewalls.

The container 100 may also include at least one structure extending from an inner surface of the body and protruding into the receptacle defined by the body to hinder nesting of a second container too far within the receptacle to avoid vacuum sealing of the containers to one another. Without such a structure an upper container may be placed too far inside of a lower container which can cause the containers to be vacuum sealed to one another. This makes it harder to use the containers (assuming the vacuum seal can even be overcome to separate the containers from one another). In the form shown, the at least one structure extending from the inner surface of the body and protruding into the receptacle defined by the body comprises four protruding structures 150A, 150B, 150C and 150D that are substantially triangular in shape and protrude from the inner sidewall of the body 102. The protruding structures 150A-D having a first end proximate the bottom wall and a second end spaced from the bottom wall and positioned above the first end, closer to the opening of the receptacle 149, with the protruding structures 150A-D protruding further into the receptacle at their first end (proximate the bottom wall) and tapering toward the sidewalls at their second end. This allows the protrusions 150A-D to engage the bottom of an upper container nested in the lower container to prevent the upper container from being inserted too far into the lower container so that no vacuum seal can occur between the two containers. The tapered shape of the protrusions further helps center the upper container within the receptacle 149 of the lower container so that the stacking of containers is made more straight.

Regarding FIGS. 1-6, a container 100 is disclosed in multiple configurations. The container 100 includes a container body 102, a lid 104 and a lock mechanism 105. The container body 102 includes a first side portion 106, a second side portion 108 and a middle portion 110. The first side portion 106 and the second side portion 108 are defined by sidewalls 106A, 106B, 106C, 106D, 106E, 106F, 106G and 108A, 108B, 108C, 108D, 108E, 108F, 108G, respectively. The container body 102 further includes feet 112A, 112B defined by the sidewalls 106A, 106B, 106C, 106D, 106E, 106F, 106G and 108A, 108B, 108C, 108D, 108E, 108F, 108G, of the first side portion 106 and the second side portion 108, respectively, and a tamper-evident tearaway portion 114 being a part of the lock mechanism 105. The middle portion 110, includes a front wall 110A, a rear wall 110B, an interior front wall 110C, an interior rear wall 110D, and a bottom wall 110E. A recess 115 extends between the feet 112A, 112B in the longitudinal direction and the front wall 110A and the rear wall 110B in the latitude direction. The recess 115 includes sidewalls 116A, 116B, tapered corners 117A, 117B, and a top surface 118 between the sidewalls 116A, 116B. The container body 102 includes a perimeter lip 119 that protrudes radially outward around the circumference of the top of the container body 102, and having a top surface 119A, and bottom surface 119B. The container body 102 further includes a container body interconnecting member 120, having a bottom portion 120A.

The first and second side portions 106, 108 are connected to the middle portion 110 by sidewalls 106D, 106E and sidewalls 108D, 108E, respectively. The length of the middle portion 110 in direction 145C is smaller than the length in direction 145C from sidewall 106C to 106F and 108C to 108F for ergonomic efficiency. Sidewalls 106A, 106B, 106C, 106D, 106E, 106F, 106G and 108A, 108B, 108C, 108D, 108E, 108F, 108G are arranged to be able to be held by a human hand.

The lid 104 includes a lock 121 which is a part of the lock mechanism 105, depressions 122, 123, the depressions 122, 123 being defined by sidewalls 122A, 122B, 122C, 122D, 122E, 122F, 122G, and 122H, and sidewalls 123A, 123B, 123C, 123D, 123E, 123F, 123G, and 123H, respectively. The lid 104 further includes a downward-extending perimeter wall 124 having a bottom surface 124A, a handle 125, and a lid middle surface 126 disposed between the depressions 122, 123.

When the container 100 is in a first closed configuration, the lock 121 on the lid 104 is engaged with the tamper-evident tearaway portion 114. The bottom surface 123A of the wall 123 of the lid 104 rests on the top surface 119A of the perimeter lip 119. When the container 100 is in a second closed configuration, the tamper-evident tearaway portion 114 is removed and the first lock 121 maintains the position of the lid 104 on the container body 102 in the second closed configuration.

Figure 2:
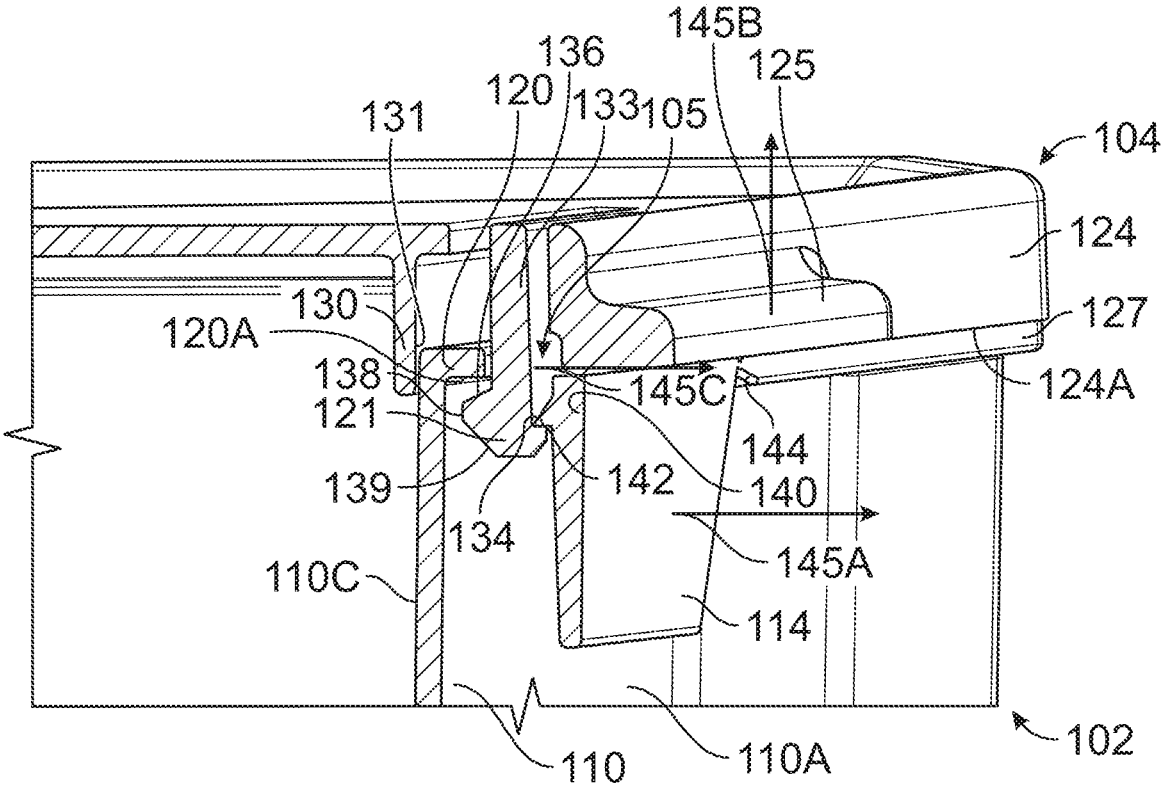
FIG. 2 is an enlarged partial cross-section view of the lock mechanism of the container of FIG. 1 taken along line 2-2 in FIG. 1.

FIG. 2 shows the lock mechanism 105 in a first closed configuration. The lock mechanism 105 is disposed on the lid 104 and the container body 102. The lid 104 includes a protrusion 130 extending downwardly from the top surface of the lid 104, and having a front surface 131. The lid 104 further includes a lid interconnecting member 133, having the first lock 121 disposed thereon, the lock 121 having a first engagement surface 134, a second engagement surface 136, a third engagement surface 138, and a user contact surface 139.

The container body 102 includes the tamper-evident tearaway portion 114 having a second lock 140 disposed thereon. The second lock 140 includes an engagement surface 142 disposed thereon. The container body interconnecting member 120 further includes an outer lip 127 having at least one frangible connection 144 which connects the tearaway tab 114 to the outer lip 127.

When in the first closed configuration, the first engagement portion 134 on the first lock 121 engages with the engagement surface 142 of the second lock 140. The tamper evident tearaway portion 114 is permanently removed when it is pulled away from the front surface 110A in direction 145 with sufficient force to break the at least one frangible connection 144. Thus, the second lock 140 is removed as such, and the first lock 121 maintains the lid 104 and the container body 102 in a second closed configuration without the second lock 140 (see FIG. 4).

Figure 3:
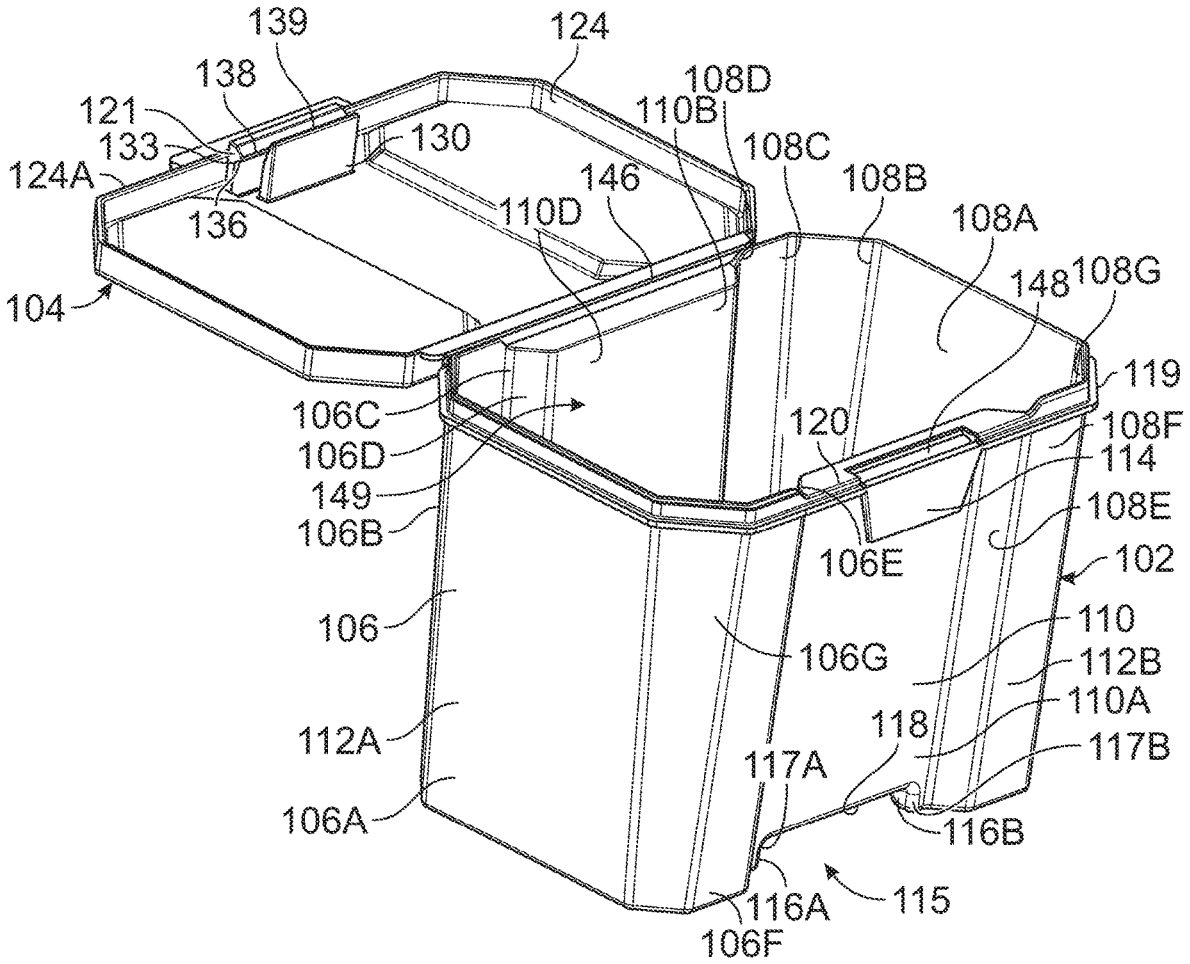
FIG. 3 is a perspective view of the container of FIG. 1 in an open configuration.

With reference to FIG. 3, the container 100 includes a living hinge 146 which forms a connection between the lid 104 and the container body 102, and also allows the lid 104 to rotate relative to the container body 102 between an open and closed configuration. When the tamper-evident tearaway portion 114 is still attached to the outer lip 127 on the container body interconnecting member 120 of the container body 102, a slot 148 is formed between the portion of the outer lip 127 disposed upon the front exterior wall 110A of the middle portion 110 and the front exterior wall 110A. When in a first closed configuration, the lid interconnecting member 133 extends through the slot 148, and the first engagement portion 134 on the first lock 121 engages with the engagement surface 142 of the second lock 140. The handle 126 may then be pulled in an upward direction 145B to rotate the lid 104 relative to the container body 102, revealing an interior cavity 149 of the container body.

The interior cavity 149 is defined by the first side portion 106 and the second side portion 108, which are defined by sidewalls 106A, 106B, 106C, 106D, 106E, 106F, 106G and 108A, 108B, 108C, 108D, 108E, 108F, 108G, respectively, and the middle portion 110, defined by front and rear walls 110A, 110B. The first side portion 106 and the second side portion 108 further include bottom walls 106H and 108H, respectively, and the middle portion 110 includes bottom wall 110E. The sidewalls 106D and 106E of the first side portion 106 connect to rear and front walls 110B, 110A, respectively, thus connecting the first side portion 106 to the middle portion 110. The sidewalls 108D and 108E of the second side portion 108 connect to rear and front walls 110B, 110A, respectively, thus connecting the second side portion 108 to the middle portion 110. The middle portion 110 of the container body 102 thus connects the first side portion 106 and the second side portion 108. Finally, the bottom wall 110E connects front and rear walls 110A, 110B, respectively, and the sidewalls 106A, 106B, 106C, 106D, 106E, 106F, 106G and 108A, 108B, 108C, 108D, 108E, 108F, 108G are arranged in a heptagonal shape on bottom walls 106H and 108H, respectively. The middle portion 110 is rectangular. The interior cavity 149 of the container body 102 is thus defined in a "dog bone" shape, but such a shape is not necessary to carry out the purpose of the container 100.

Figure 4:
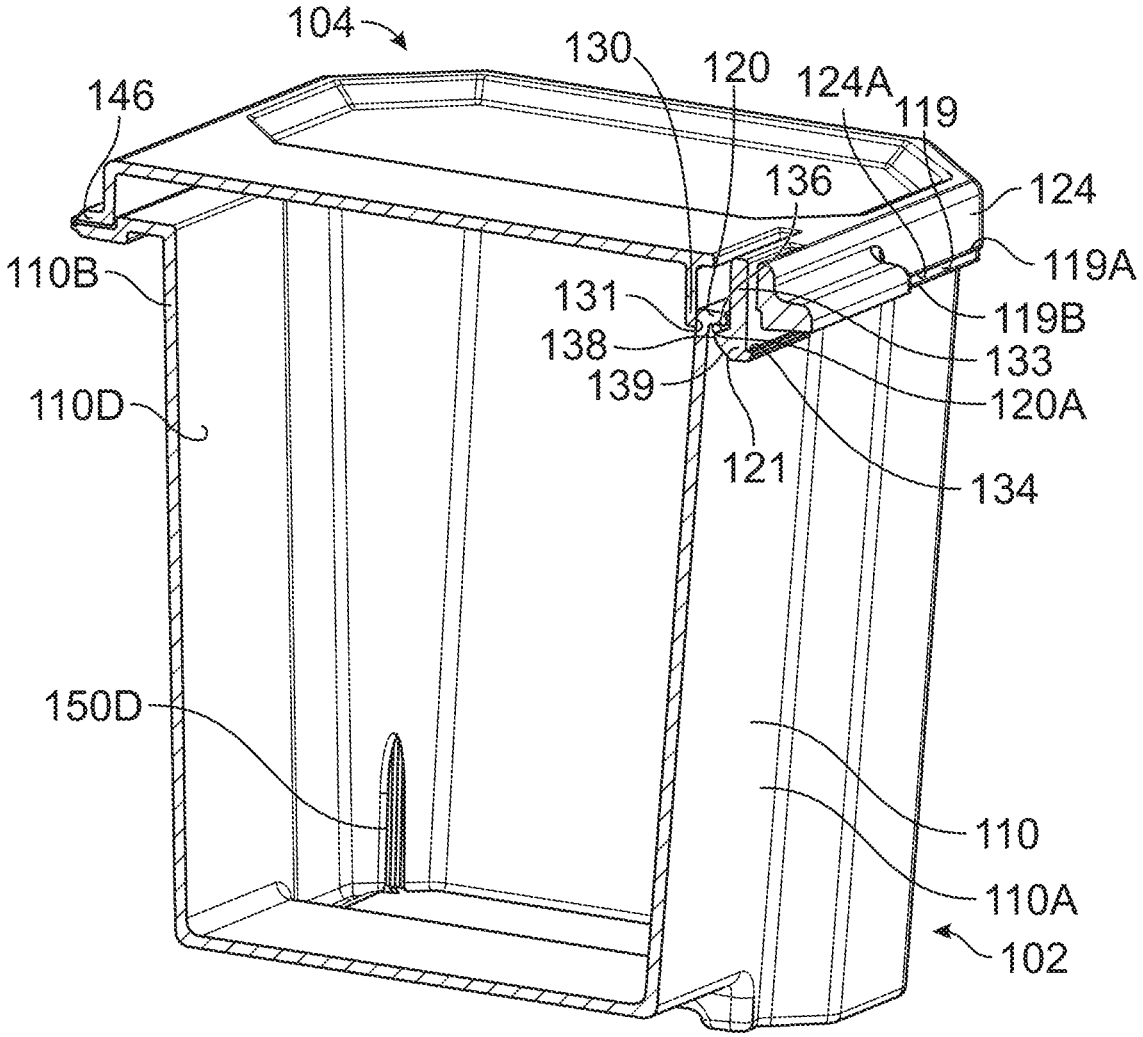
FIG. 4 is a side perspective cross-section view of the container of FIG. 1 again taken along line 2-2 in FIG. 1 and illustrating the container with the tamper-evident seal removed.
Figure 5:
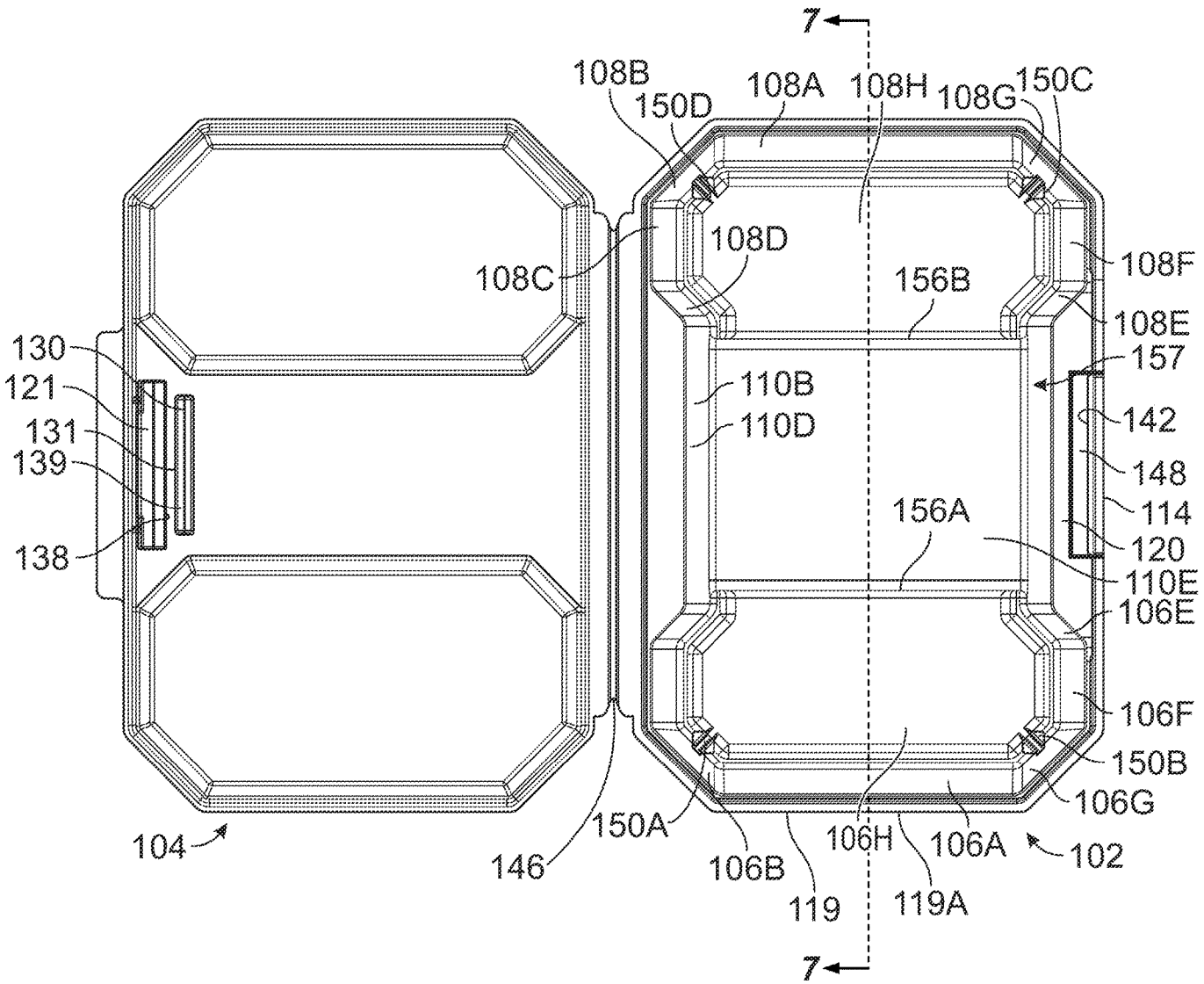
FIG. 5 is a top view of the container of FIG. 1 in the open configuration.

With reference to FIG. 4, in the second closed configuration, the third contact surface 138 engages the front wall 110A of the container body 102 and the second engagement surface 136 engages with the bottom portion 119A of the lip 119, thus assisting in maintaining the engagement of the lid 104 with the container body 102. Further, the engagement portion 131 of the protrusion 130 contacts the interior wall 110C of the container body 102. The force from the third contact surface 138 on the front wall 110A of the container body 102 further provides a friction fit for holding the lid 202 and container body 204 in the second closed configuration.

To disengage the lock 121, a user grips the lock 121 at the user contact surface 139 and applies a force sufficient to move the lock 121 along the bottom 120A of the container body interconnecting member 120 in the direction 145C. The lid 104 thus becomes disengaged from the container body 102, and the container 100 is in an open configuration.

Regarding FIGS. 5-8, the container 100 further includes angular protrusions 150A, 150B, 150C, and 150D, and the sidewalls 106A, 106B, 106C, 106D, 106E, 106F, 106G and 108A, 108B, 108C, 108D, 108E, 108F, 108G are tapered inward into the interior cavity 149 from the lip 119 of the container body 102 to the interior bottom surfaces 106H, 108H, 110E of the container body 102.

The container body 102 further includes taper 156A connecting the bottom surface 106H of the first side portion 106 to the bottom surface 110E and taper 156B connecting the bottom surface 108H of the second side portion 108 to the bottom surface 110E, thus forming a bottom surface 157.

The first and second side portions 106, 108 further include exterior bottom surfaces 106I, 108I, which are disposed inside perimeter ridges 106J, 108J, respectively. When nesting at least two containers 100A, 100B one within the other, the angular protrusions 150A, 150B, 150C, and 150D serve to limit the nesting by coming in contact with perimeter ridges 106J, 108J, respectively. Additionally, the tapered nature of the sidewalls 106A, 106B, 106C, 106D, 106E, 106F, 106G and 108A, 108B, 108C, 108D, 108E, 108F, 108G within the interior cavity 149, assists to keep the container 100B from nesting too far in to the container 100A (see FIG. 7).

In some embodiments, the protrusions may be angled as the protrusions rise from the bottom surface, up the sidewall, and toward the top of the container. The protrusions may also be rectangular or square in shape.

Figure 6:
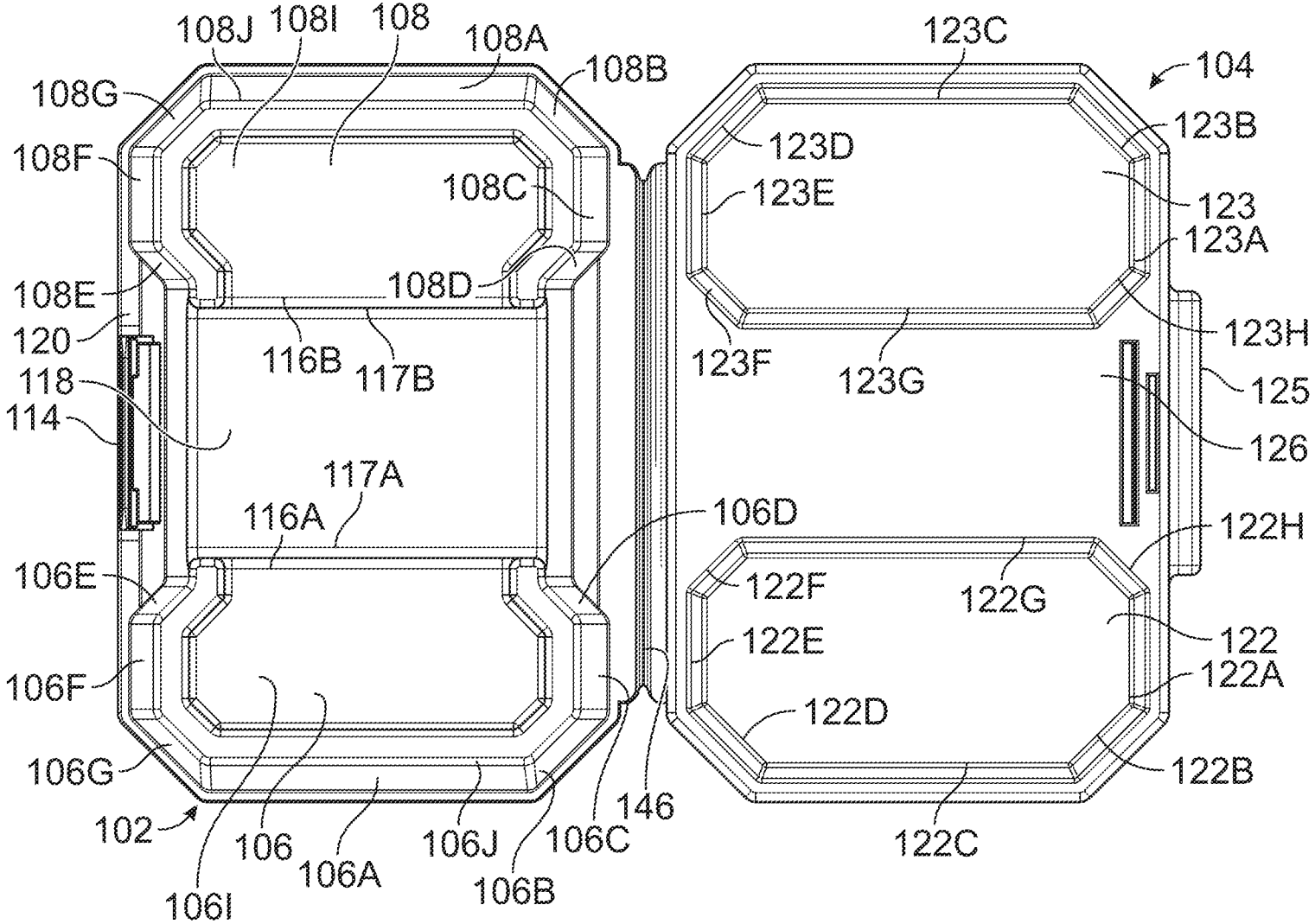
FIG. 6 is a bottom view of the container of FIG. 1 in the open configuration.
Figure 7:
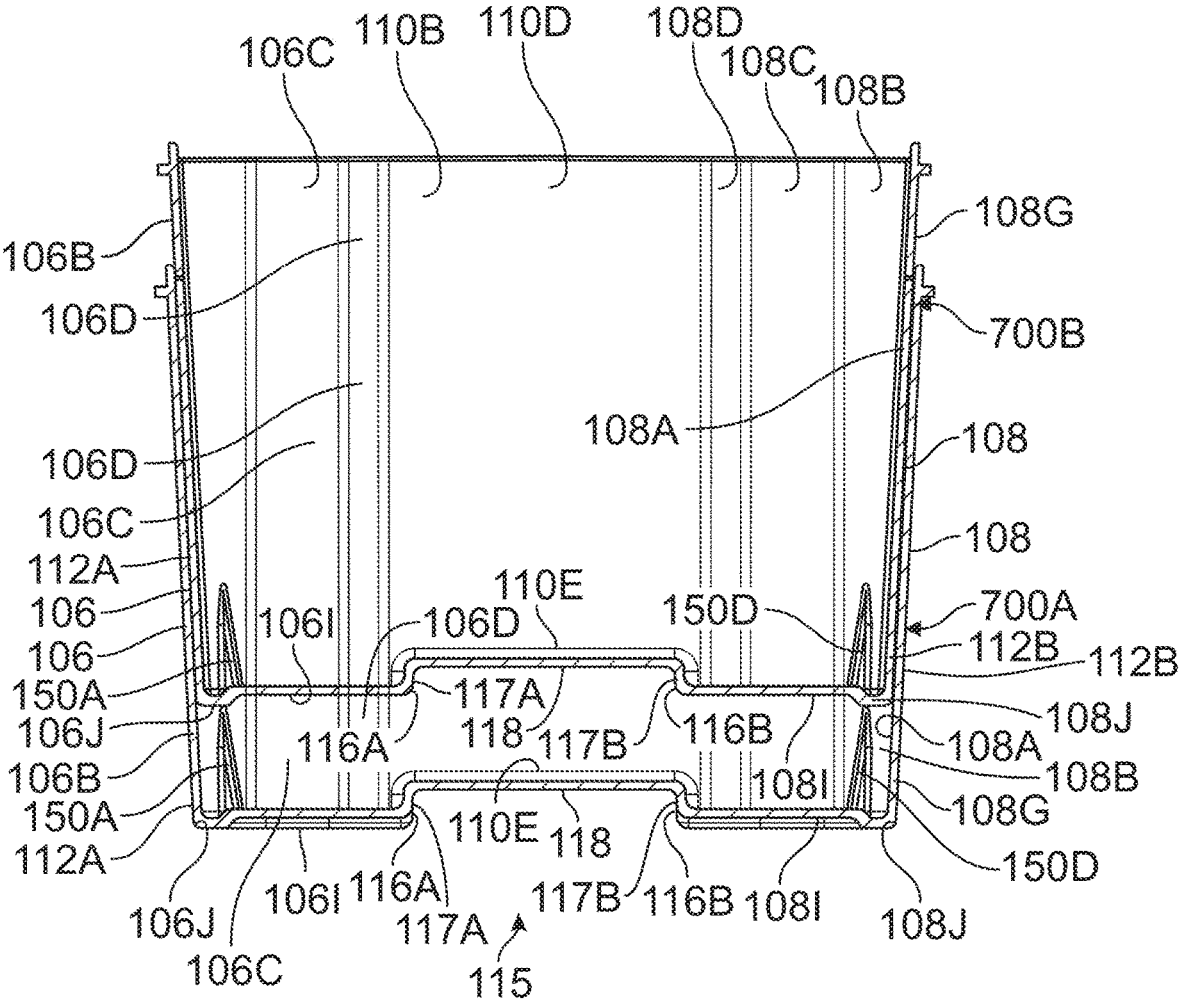
FIG. 7 is a cross-section view of two containers of FIG. 1 in a nested configuration taken along line 7-7 in FIG. 5.
Figure 8:
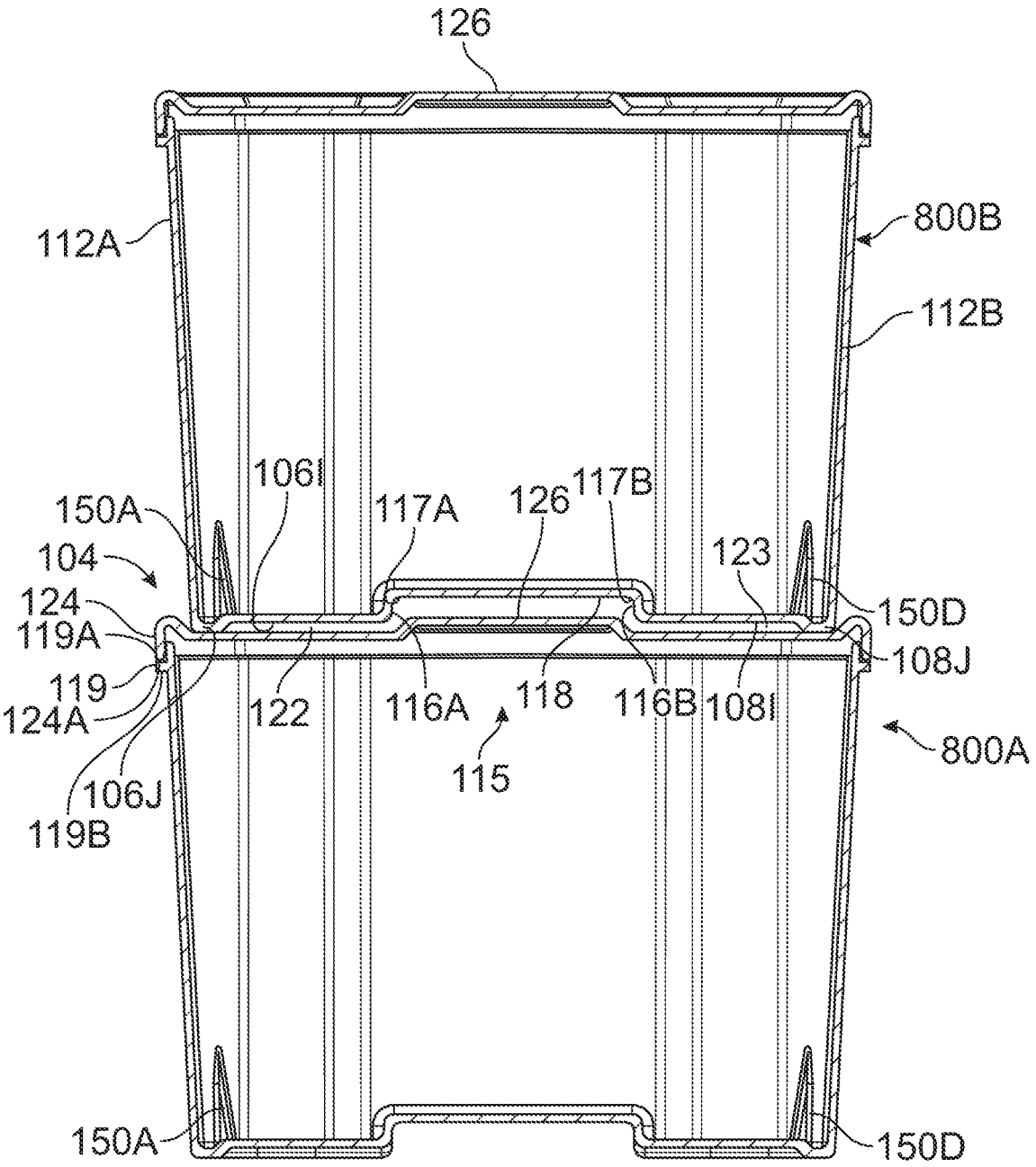
FIG. 8. is a cross-section view of two containers of FIG. 1 in a stacked configuration and taken along line 7-7 in FIG. 5.

Regarding FIGS. 6 and 8, the sidewalls 122A, 122B, 122C, 122D, 122E, 122F, 122G, and 122H, and sidewalls 123A, 123B, 123C, 123D, 123E, 123F, 123G, and 123H, of the depressions 122 and 123, respectively, complement the perimeter ridges 106J and 108J, respectively. Referring to FIG. 8, a first container 800A and a second container 800B are shown, wherein the first and second containers 800A and 800B have the same features of the container 100 as shown in FIGS. 1-6. The top surface 118 of the recess 115 on the top container 100 and the sides 116A and 116B are spaced such that the top surface 118 clears the lid middle surface 126 of the lid 104. The top and bottom surfaces 119A, 119B of the perimeter wall 119, are reinforced such that the first container 800A can bear the weight of the second container 800B.

Figure 9:
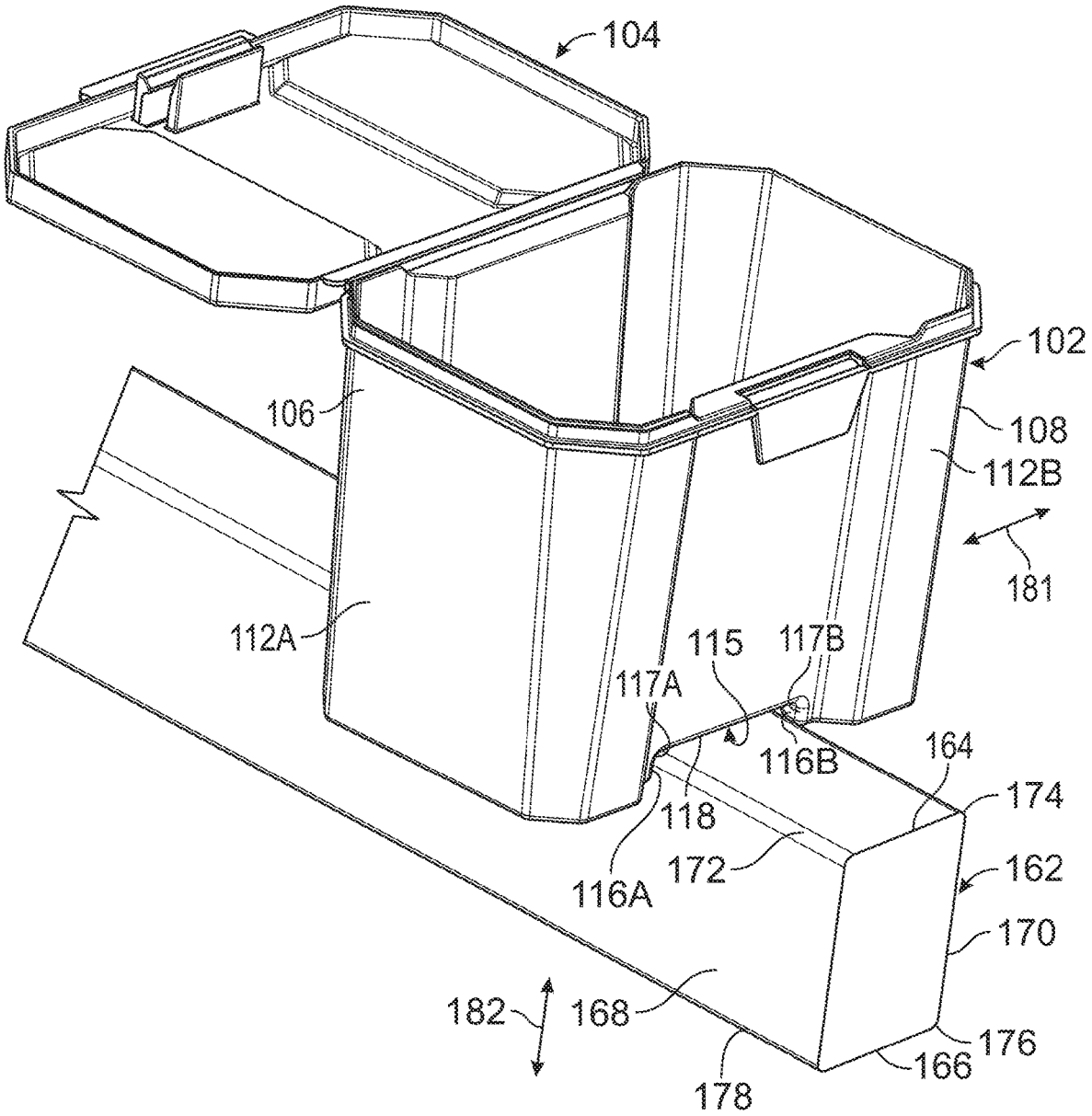
FIG. 9 is a perspective view of the container of FIG. 1 resting on a wood board such that the board is disposed in the recess located in the bottom of the container to securely rest the container on the board.

With reference to FIG. 9, the recess 115 of the container body 102 may be sized to fit on a wood board 162. The wood board 162 may have a top surface 164, a bottom surface 166, side surfaces 168, 170, and rounded edges 172, 174, 176, and 178. The sides 116A, 116B of the wood board 162 may be spaced sufficiently apart in a direction 180, such that the top or bottom surface 164, 166 of the wood board 162 will come in contact with the top surface 118 of the recess 115 of the container body 102, the tapers 117A, 117B will complement the rounded edges 172, 174, 176, 178 and the sides 116A, 116B will come in contact with the side surfaces 168, 170 of the wood board 162, for a friction fit allowing the container body 102 to rest on the wood board 162 with a snug fit, when the wood board 162 is inserted in the recess, with the top and bottom sources 164, 166 oriented in a direction defined by arrow 182.

In other forms, the container may be configured in the shape of a rectangle, an hourglass, or, it may have diamond shapes for the first and second side portions. These container body shapes will have the same perimeter lip, outer lip, locking mechanism, and tamper-evident tearaway portions. The arrangement of sidewalls on the bottom surfaces of the first and second side portions will be such that they from the above-described shapes.

In addition to the various shapes and configurations that can be created using the inventions disclosed herein, it should be understood that numerous methods are also disclosed herein. For example, a method of forming a container is disclosed comprising integrally molding a container in a mold having: (a) a body defining a receptacle for receiving an article disposed therein and having an opening providing access to the receptacle; and (b) a lid integrally formed with the body and connected to the body via a living hinge, the lid being movable between a first open position wherein the opening to the receptacle is at least partially uncovered and a second closed position wherein the lid covers the opening of the receptacle defined by the body. The method may further include forming a lock for securing the lid to the body when the lid is placed in the second position, the lock being movable between a first lock position and a second release position. In some forms, forming the lock includes forming a tamper-evident seal on the lock that prevents the lid from being opened or moved from the second closed position until the seal is removed. The tamper-evident seal prevents the lid from being opened or moved from the second closed position until the seal is removed. In a preferred form, a method of providing an integrated lock and tamper-evident seal is disclosed herein.

In other forms, a method of forming a container is disclosed in which a recess is formed in the container body for receiving at least a portion of an object so that the container may be rested on the object. In still other forms, the method includes forming at least one structure extending from an inner surface of the body and protruding into the receptacle defined by the body to hinder nesting of a second container too far within the receptacle to avoid vacuum sealing of the containers to one another. The body may be formed by a bottom wall with sidewalls extending upward therefrom, and the at least one structure extending from the inner surface of the body and protruding into the receptacle defined by the body comprises forming four protruding structures that are substantially triangular in shape and protrude from the sidewall of the body, with the protruding structures having a first end proximate the bottom wall and a second end spaced from the bottom wall above the first end and closer to the opening of the receptacle. In some forms, the protruding structures protrude further into the receptacle at their first end proximate the bottom wall and tapering toward the sidewalls at their second end. In a preferred form, the protruding walls are tapered and positioned proximate the four corners of the container and help center an upper container when it is nested within the lower container.

Thus, it should be understood that numerous methods and apparatus are disclosed herein for containers and the making of same, as well as individual features of the container (e.g., locks, tamper-evident seals, anti-vacuum sealing structures, etc.). This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims. Further, it should be understood that features of one embodiment described herein may be combined with features of other embodiments described herein in order to develop yet further embodiments and such further embodiments are contemplated within this disclosure.

What is claimed is:

1. A one-piece molded container comprising:

a lid;

a container body connected to the lid by a living hinge such that the lid is movable between an open position and a closed position, the container body having interior angular protrusions extending from a bottom portion in an interior of the container body to limit nesting of the containers, a container body interconnecting member, a tamper-evident tearaway portion depending from a rim of the container body and spaced apart from the container body interconnecting member to form a slot through the rim of the container body, and a recess on a bottom portion on an exterior portion of the container body; and a lid-locking mechanism, the lid-locking mechanism including a first lock disposed on a lid interconnecting member extending through the slot, the first lock engaging the container body interconnecting member to prevent the lid from moving from the closed position, the first lock being elastically deflectable from an original position to disengage the first lock from the container body interconnecting member to move the lid toward the open position, a second lock being disposed on the tamper-evident tearaway portion and engaging the first lock to prevent the first lock from being deflected from the original position, and a rectangular protrusion extending downwardly from an interior portion of the lid to engage an interior surface of the container body when the lid is in the closed position.

2. The container of claim 1, wherein the container body interconnecting member has a bottom portion and a slot sized to receive the first lock and the lid interconnecting portion, and the first lock has first, second, and third engagement surfaces.

3. The container of claim 2, wherein the second engagement surface of the first lock is engageable with the bottom portion of the container body interconnecting member to lock the lid shut in a second closed configuration.

4. The container of claim 2, wherein the container body interconnecting member and the tamper-evident tearaway portion are connected by an outer lip in a first closed configuration.

5. The container of claim 4, wherein the second lock has an engagement surface engageable with the first engagement surface of the first lock in the first closed configuration.

6. The container of claim 4, wherein the tamper-evident tearaway portion is removably attached to the outer lip by at least one frangible connection in the first closed configuration.

7. The container of claim 1, wherein the rectangular protrusion is rearward of the first lock.

8. The container of claim 1, wherein the container body has a perimeter rim, and wherein the perimeter rim extends radially outward from the container body.

9. The container of claim 1, wherein the tamper-evident tearaway portion has a frustoconical shape.

10. The container of claim 1, wherein the container has a first side portion and a second side portion and a middle portion extending between the first side portion and the second side portion and having a narrowed width relative to the first side portion and second side portion to form an overall cross-section having the shape of a dog bone, and wherein an opening in the top of the container is large enough for a human hand to reach in and retrieve a piece or pieces of hardware.

11. The container of claim 1, wherein the recess on the bottom portion of the container body is sized to receive a 2"×4" building material structure, and wherein the recess is disposed between two feet in the bottom portion of the container body.

12. The container of claim 11, wherein the lid has two depressions complementary to and sized to receive feet in a bottom portion of another container body for stacking.

13. The container of claim 11, wherein the recess is transverse to the longitudinal axis of the container.

14. A one-piece molded container comprising:

a lid having depressions for receiving feet of a second one-piece molded container;

a container body having a recess on a bottom portion of the container body, the recess being transverse to a longitudinal axis of the container body, the recess further being sized to receive a wood board;

a first lock disposed on a lid interconnecting member extending downwardly from the lid;

a rectangular protrusion extending downward from an interior portion of the lid, the rectangular protrusion disposed rearward of the first lock;

a second lock extending downwardly from an upper rim of the container body, the second lock being disposed on a tamper-evident tearaway portion being removably attached to the container body, the second lock engaging the first lock to maintain the first lock in a locked configuration;

a slot formed in part by the container body interconnecting member, the slot being sized to receive the first lock and lid interconnecting member for locking the lid in a closed position;

angular protrusions formed in an interior portion of the container body, the angular protrusions being capable of limiting nesting of a first one-piece molded container in a second one-piece molded container;

feet formed on the bottom portion of the container, the feet sized to be received by complementing depressions on a lid of a second one-piece molded container; and a living hinge connecting the lid and the container body, such that the lid is pivotable relative to the container body.

15. The one-piece molded container of claim 14, wherein the tamper-evident tearaway portion is in a frustoconical shape.

16. The one-piece molded container of claim 14, wherein the protrusion has a width that is less than the width of the first lock.

* * * * *